United States Patent [19]

Bayless

[11] Patent Number: 4,821,469

[45] Date of Patent: Apr. 18, 1989

[54] LIBRARY STRUCTURE FOR VIDEO LIBRARY OF REAL ESTATE PROPERTIES

[76] Inventor: Gary Bayless, 1761 N.W. 9th Ave., Homestead, Fla. 33030

[21] Appl. No.: 144,304

[22] Filed: Jan. 14, 1988

[51] Int. Cl.[4] ..... E04H 3/04

[52] U.S. Cl. ..... 52/33; 52/234; 52/6

[58] Field of Search ..... 52/33, 6, 234, 169.3

[56] References Cited

U.S. PATENT DOCUMENTS

| | | | |
|---|---|---|---|
| 1,348,024 | 7/1920 | McCarty | 52/33 |
| 1,463,633 | 7/1923 | Smith | 52/33 |
| 1,474,106 | 11/1923 | Carroll | 52/33 |
| 1,766,409 | 6/1930 | Stocks | 52/33 |
| 3,531,898 | 10/1970 | Facemire | 52/6 |
| 4,154,027 | 5/1979 | Searcy | 52/33 |
| 4,259,816 | 4/1981 | Bergquist | 52/33 |

FOREIGN PATENT DOCUMENTS

| | | | |
|---|---|---|---|
| 367456 | 2/1932 | United Kingdom | 52/33 |

*Primary Examiner*—Henry E. Raduazo
*Attorney, Agent, or Firm*—John C. Malloy

[57] ABSTRACT

A library structure for housing in an organized and catalogued fashion a plurality of video tapes about real estate properties and related services which includes cabinets and teaser video screens displaying interesting or featured properties to attract potential customers of real estate property services.

3 Claims, 3 Drawing Sheets

TYPICAL PAGE IN PICTORAL CATALOG

LIBRARY STRUCTURE FOR VIDEO LIBRARY OF REAL ESTATE PROPERTIES

FIELD OF THE INVENTION

This invention relates to a library structure particularly one to house video tapes of various real properties.

BACKGROUND OF THE INVENTION

Media advertising is expensive for those persons desiring to buy or sell real estate, such as a home. There is a need for a description of the property to be bought or sold and various other aspects about an individual property. In the past, it has been possible to make a video film of a real estate location, but most sellers normally cannot afford the expense associated with such. The cost is not necessarily a function of the production of the video tape. Rather, it is the distribution or communication of the tape contents to a large enough audience. The present invention is of a library in which video tapes are arranged, cataloged and adapted to be viewed by persons interested in purchasing a property. This reduces the overall cost of communicating the content of the films to the public.

SUMMARY OF THE INVENTION

The invention is therefore of a library for real estate video tapes which is intended to be located at a high pedestrian traffic location. Persons are attracted to the service by monitors which present a slide show through the front windows of the library. If one is interested and enters the library, it is arranged so that little or no assistance is required in order for them to be able to view five or ten video tapes per hour. The library includes a reference system which will include a pictorial catalog at a work station so that a person can identify properties in which there is an interest, such as three-bedroom, two-bath homes in a certain geographic area. The pictorial catalog will contain indicia on the catalog entries as to where in the library the video tape can be obtained for viewing in video rooms which are provided within the library. When a photo in the pictorial catalog is selected, one merely proceeds to the shelf section in which the video tapes are arranged in cabinets with special identification numbers, selects the tape to be viewed, and proceeds to view it in one of the viewing rooms which are provided. The cabinets where the films are displayed are divided into the various groupings. By way of example, the cabinets may be identified by letters such as A, B, C, etc. Once the proper section is identified, the reference number taken from a sheet in the pictorial catalog is used to correctly identify the selected property on film. With the film in hand, it can be viewed in the viewing rooms which are fully equipped with the required television monitors, etc. Each video will provide important details of the property and be of about two or three minutes in duration with appropriate narration describing details about the property and comments concerning the surrounding area. The film will also include the name and telephone number of the advertiser for use by the viewer.

When the viewing of a film is completed, they will have a complete description far superior to that which can be afforded in classified advertising or home magazines.

If a potential buyer is interested in a particular property, he can then proceed to the property to view it physically. The library features are enhanced by two large screen monitors which face the front windows of the library. Additionally, there are three or more large screen monitors at various locations in the store interior. On these there will be randomly broadcast specific films to draw attention to special properties or the like. It is intended that the interim monitors will continuously show a very limited number of currently available homes. The customer of the library will pay an additional charge for this extra exposure on the films, which has the advantage of immediately making anyone aware of the availability of their home. The two monitors facing through the transparent front windows are designed to be used to display slides cyclically of various properties instead of an actual video. The slides of the properties are projected for a short period of time, for example, 15 to 20 seconds, while always indicating the advertiser's name and phone number, plus the location and sales price and the information about where in the library further information can be obtained from a video film detailing the specific property.

It is also contemplated that the library will have a section devoted to real estate related services, so that persons in the person can advertise their professional expertise. For example, there will be a portion of the library devoted to services such as title services, bank services, etc. These films can be viewed in the viewing rooms and for the professionals provide an advertising medium of their services. Such films might include a video about attorneys, banks, insurance companies, and real estate agencies.

Thus, it is seen that the library provides a potential home buyer an ability to search for a home of a given type in a given location with substantial ease. Countless hours of visiting homes are drastically reduced in the selection process. The viewing of each video tape provides substantial information about a home far in excess of what could be made available in handouts and advertisements. In summary, the library gives prospective purchasers an opportunity to see what they want and when they want to see it and the opportunity to make a private choice of whether to call or not to call the particular person selling a given piece of property

OBJECTS OF THE INVENTION

It is a general object of this invention to provide a library for real estate films which includes viewing rooms for video tapes and wherein the video tapes are arranged and cataloged so that one entering the store can easily locate the video tapes of homes of a particular type, as is set forth more fully hereinafter.

DESCRIPTION OF THE PREFERRED EMBODIMENT

Figure 1:
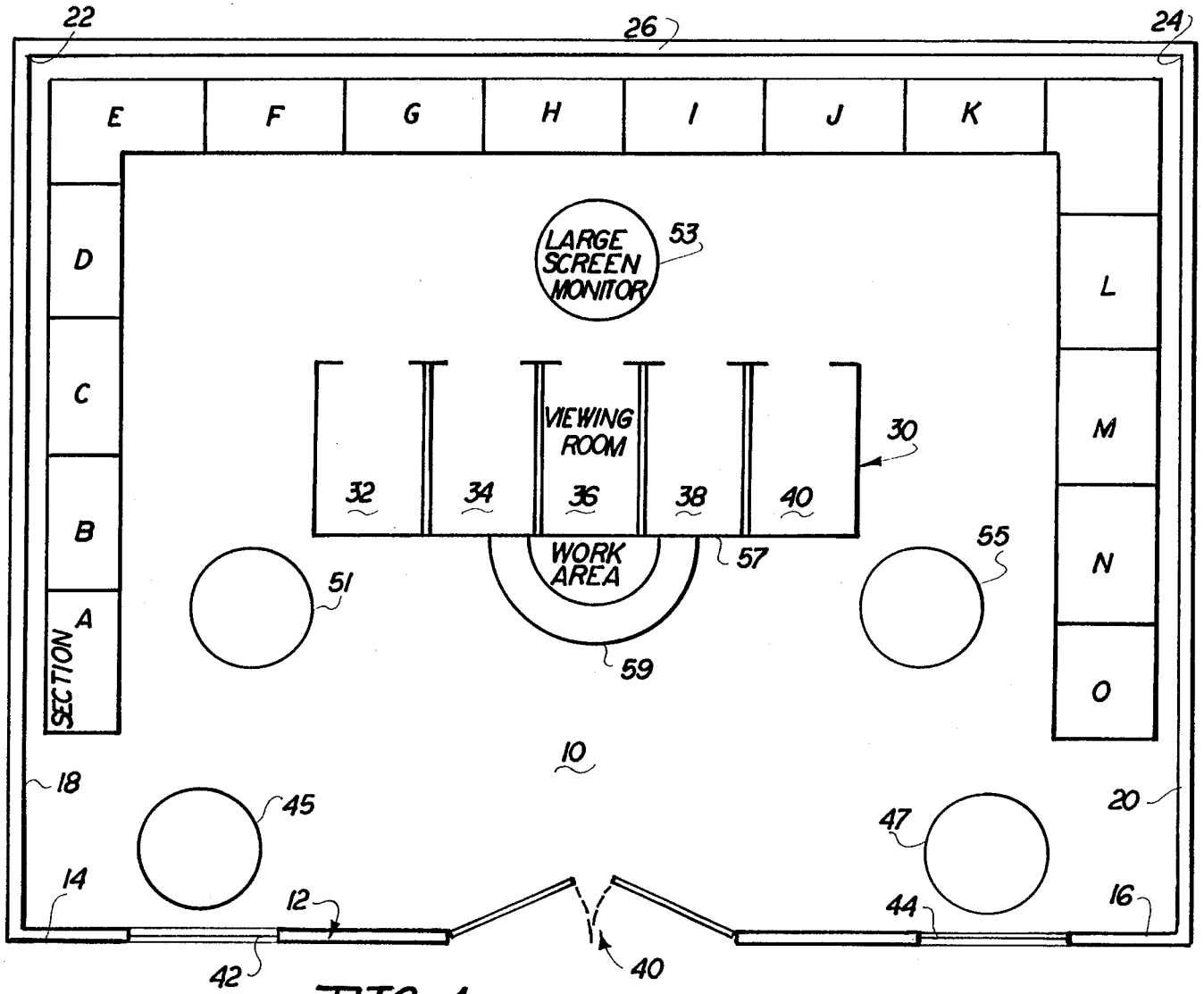
FIG. 1 is a plan view of the library constructed in accordance wit is invention.
Figure 2:
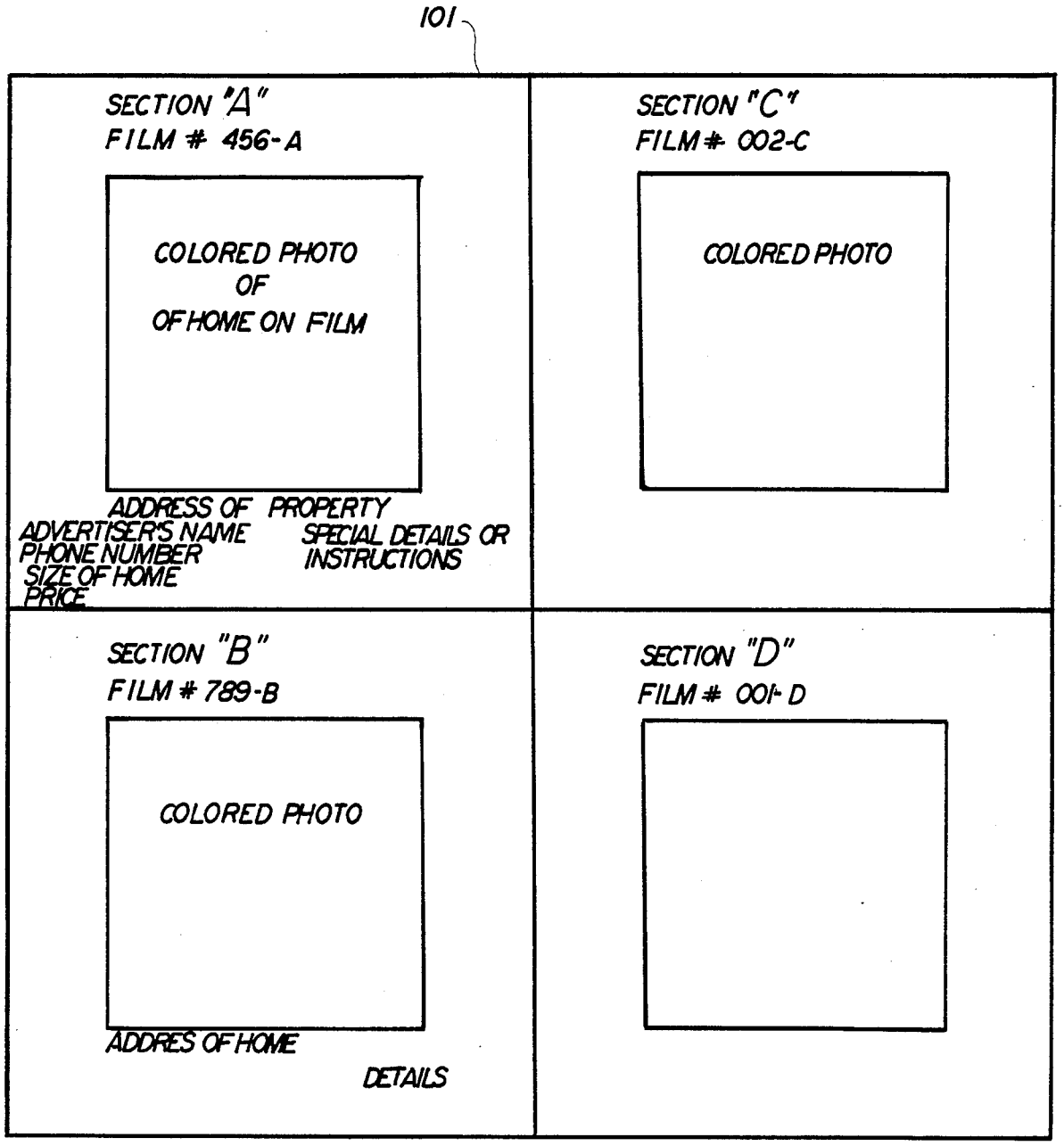
FIG. 2 is a illustrative view of a sheet from a catalog used library.
Figure 3:
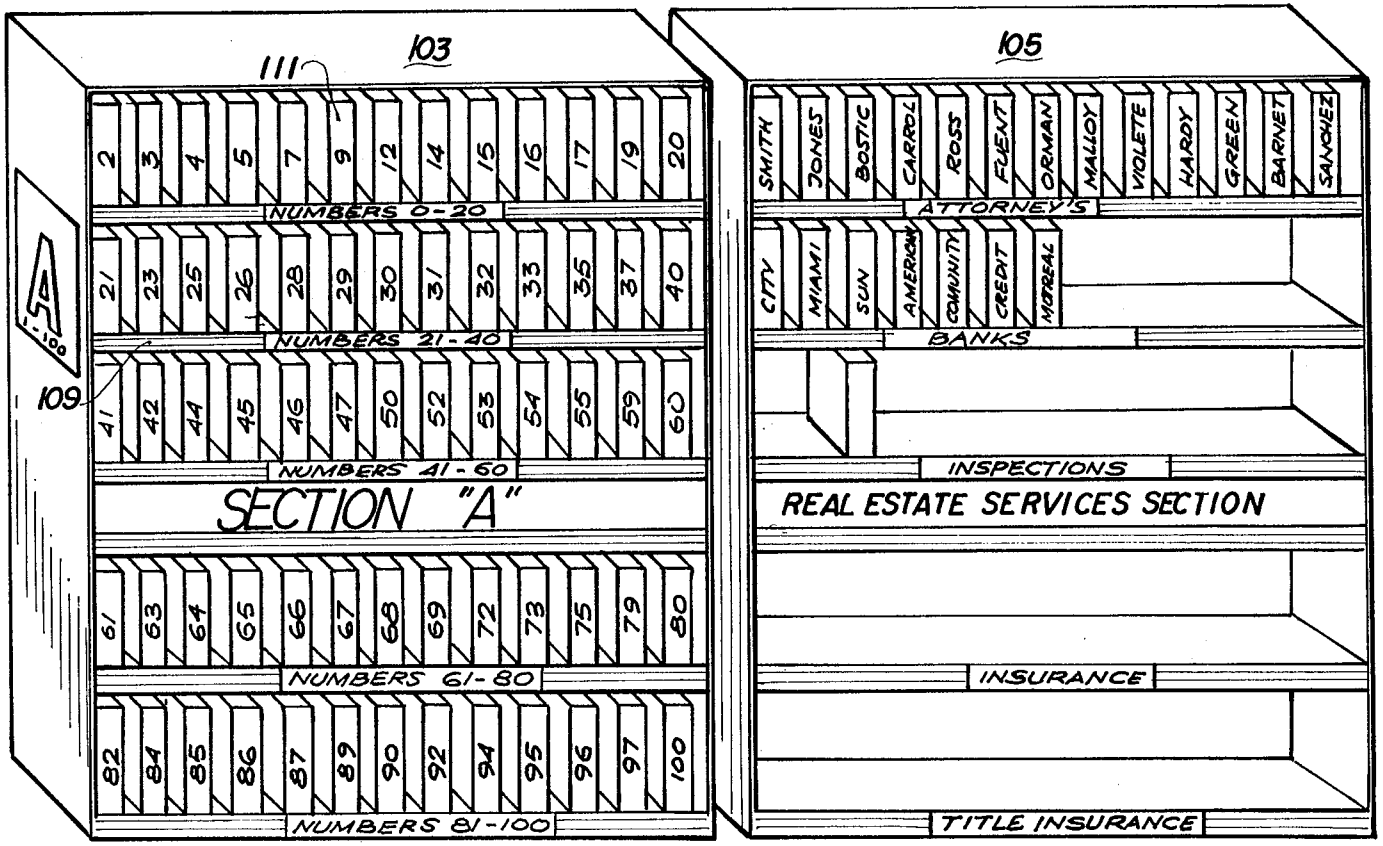
FIG. 3 is a perspective view illustrating cabinets with shelving for housing video tape containers.

In FIG. 1 there is a plan view shown of the library generally designated by the numeral 10. It includes a front wall 12 having a pair of opposite ends 14 and 16. The front wall spans a distance of about 30 feet. Extending away from the opposite ends of the front wall are side walls 18 and 20. The extending ends of the side walls 22 and 24 are spanned by a rear wall 26. There is thus defined a peripheral zone adjacent the walls, a central zone and an intermediate zone between the peripheral zone and the central zone. The structure generally designated by the numeral 30 is provided in the central zone which defines a plurality of video tape viewing rooms, such as 32, 34, 36, 38 and 40. Each of these rooms is provided with electronic equipment to display the real estate video tapes. Preferably, the openings of the viewing rooms face the rear wall. Additionally, the walls are lined with cabinets such as A through K as is described more fully hereinafter. An entrance opening 40 which preferably includes doors to be opened and closed is provided in the front wall 12. The front wall includes a transparent portion such as 42 and 44 on opposite sides of the entrance opening Facing each of the transparent portions of the front wall there is a large screen monitor such as 45 and 47, where specifically slides are presented to the pedestrian traffic so that their interest will be attracted. Within the peripheral zone, preferably three large screen monitors are provided such as 51, 53 and 55. These screens will provide information about selected properties. Preferably the structure 30 defining the viewing rooms will have a front wall 57 and a work station or desk 59. At this work station, there will be catalogs which include pages, such as that shown in FIG. 2 and designated generally by the numeral 101. Each of the catalog pages will have one or more color photos of homes which can be viewed on video tapes in the library. The catalog sheets will, in addition to the color photo of a property, include an identification of where in the library the particular video film of that home can be located. Also, it will include special details about the property and the name and address, size and price of the property. Along the walls there are provided the cabinets which are generally designated by the numeral 103 and 105 in FIG. 3. Referring more in detail to the cabinet structure A, which is designated 103 in FIG. 3, it is seen that shelves are arranged in each cabinet such as that designated by the numeral 109 and along each of the shelves there are provided the video tapes such as 111 which can easily be removed. One simply looks at the catalog pages, see FIG. 2, and identifies which section or cabinet where the film corresponding to the color photo of the home can be located. As shown in the cabinet designated 105, in addition to the homes, there may be video tapes provided for real estate services, such as title insurance, appraisers, etc. In use, one enters the store, views on the large screen monitor or the pages from the catalog what properties he is interested in, and at that same location is able to obtain the identification of their location. He then proceeds to the shelving of the cabinet means, removes the tape he is interested in, and views it in the viewing room.

This invention has been shown and described in a practical and preferred manner and is therefore not to be limited except as set forth in the claims hereinafter.

What is claimed is:

1. A video tape library comprising:

a front wall having a pair of opposite ends and spanning a distance of about at least 30 feet;

a first side wall extending away from one of said opposite ends to a rear end and a second wall extending away from the other of said opposite ends to a rear end;

a rear wall spanning the rear ends of said first and second side walls;

said walls defining a peripheral zone adjacent said walls, a central zone, and an intermediate zone between said peripheral and central zones;

an entrance opening in said front wall between said opposite ends including door means to close and to open said opening; said front wall including a transparent portion between each of said ends and said opening;

structure in said central zone defining a qroup of video tape viewing rooms, each of said rooms having an entrance facing away from said front wall;

a pair of monitor means in the peripheral zone adjacent said front wall to display slide pictures cyclically, one of said monitor means being adjacent and confronting each of said transparent portions for viewing by persons outside of said library.

video storage means along said side and rear walls displaying a plurality of organized and cataloged video tape containers, said containers containing video tapes of real estate;

a live screen monitor means in the intermediate zone between the central zone and the rear wall and each of said side walls; and said structure in said central zone including work station means facing said opening between said live screen monitor means and including catalogs to identify and locate said video tape containers in said cataloged video storage means, so that persons entering the opening face the work station means and can optionally, view said large screen monitor means and can obtain information about the location in the storage means of specific tape containers to be selected and viewed in one of said rooms.

2. The library as set forth in claim 1 wherein said storage means comprise a plurality of video storage cabinet means.

3. The library as set forth in claim 1 wherein identification means are arranged on said cabinet means.

* * * * *